US005295720A

United States Patent [19]

Budde

[11] Patent Number: 5,295,720

[45] Date of Patent: Mar. 22, 1994

[54] MOTOR VEHICLE DOOR LOCK

[75] Inventor: Ulrich Budde, Bergneustadt, Fed. Rep. of Germany

[73] Assignee: BOMORO Bocklenberg & Motte GmbH & Co. KG, Wuppertal, Fed. Rep. of Germany

[21] Appl. No.: 41,429

[22] Filed: Mar. 31, 1993

[30] Foreign Application Priority Data

Apr. 13, 1992 [DE] Fed. Rep. of Germany ..... 4212327

[51] Int. Cl.[5] ..... E05C 3/26; E05B 47/00

[52] U.S. Cl. ..... 292/201; 292/216; 292/341.16; 292/254; 292/DIG. 41

[58] Field of Search ..... 292/201, 254, 341.16, 292/341.17, 341.19, DIG. 41

[56] References Cited

U.S. PATENT DOCUMENTS

| | | | |
|---|---|---|---|
| 2,068,063 | 1/1937 | Miller | 292/254 |
| 4,441,345 | 4/1984 | Guarr | 70/240 |
| 4,773,241 | 9/1988 | Peitsmeier et al. | 70/252 |
| 4,938,042 | 7/1990 | Muramatsu | 70/245 |
| 5,025,880 | 6/1991 | Koto | 292/216 X |
| 5,052,204 | 10/1991 | Millar | 70/256 |
| 5,217,266 | 6/1993 | Köstler | 292/201 |

*Primary Examiner*—Richard E. Moore

*Attorney, Agent, or Firm*—Sixbey, Friedman, Leedom & Ferguson

[57] ABSTRACT

A motor vehicle lock for a motor vehicle closure member having a locking catch that is movable between an unlatched position and a latched position, a pawl for holding the locking catch in the latched position by latching engagement therewith, and a locking pin rotatably mounted on a carrier for rotation about an axis of rotation which is eccentric to a central axis thereof in which the locking pin is rotatable by a motor between a preliminary locking position and a main locking position and in which the pawl is disengageable from latching engagement with the locking catch by a dynamic effect derived from the rotation of locking pin from the main locking position in a direction toward the preliminary locking position, thereby releasing the locking catch. This dynamic effect is achieved, in accordance with preferred embodiments by a control flange on the locking pin which coacts with of the pawl.

7 Claims, 2 Drawing Sheets

MOTOR VEHICLE DOOR LOCK

BACKGROUND OF THE INVENTION

1. Field of the Invention

The invention relates to a lock for a motor vehicle closure member such as a motor vehicle door, hood or trunk or tailgate lid. More specifically, the invention is directed to such a lock that is provided with a locking catch (latch member) that can be shifted from a latched position to an unlatched position, and a locking pin (striker) that engages the locking catch and is mounted on a support plate (striker plate) at a position that is eccentrically offset from the axis of rotation of the support plate, a solenoid motor being provided for rotating the support plate between a preliminary locking position (partially open position) and a main locking position (fully closed position).

2. Description of Related Art

The known motor vehicle lock of the initially-mentioned type, upon which the present invention is based (U.S. Pat. No. 4,775,178 to Boyko), is suitable as a door lock, hood lock or trunk lid lock for motor vehicles, and in the example disclosed in the noted patent, is used as a door lock for a sliding door of a van-type vehicle. Power motor vehicle locks, i.e., locks that are operated by a solenoid motor, are also especially important for hoods and hinged lids, for example, for trunk lids and station wagon tailgates, because of the forces necessary there.

While in other known motor vehicle door locks the locking catch, in most cases a forked rotary latch member is moved from the preliminary locking position into the main locking position in a motor-assisted manner (also reversed for a power-assisted opening), in the Boyko motor vehicle lock, from which the invention starts, the movement of the two body parts against one another, between the preliminary locking position and main locking position, is brought about by eccentric displacement of the locking pin around the axis of rotation of the support plate. Thus, in the Boyko design, the locking catch is held only in the main locking position, and to bring the position of the locking catch, including the locking pin and related lock mechanism, from the preliminary locking position into the main locking position, the locking pin must be eccentrically rotated. However, the eccentricity of the locking pin relative to the axis of rotation depends on the desired path between preliminary locking position and main locking position, and a sizeable eccentricity has the drawback that the locking pin performs a relatively great lateral relative movement in the mouth of the locking catch, to which the mouth of the locking catch has to be matched.

Also in the Boyko motor vehicle lock, various switches are provided for detecting different positions of locking pin via an actuating arm and control elements associated therewith. When opening the door lock, the locking pin is detached from the locking catch by pulling on an opening lever to release the locking catch, so that it can return to the open position, opening the door. Here, the locking pin follows the movement of the door, which opens under the action of the return spring power of the door sealing element. Simultaneously with disengagement of the locking pin and return of the locking catch into the opening position, a switch is actuated, which triggers the untwisting of the locking pin from the main locking position into the preliminary locking position by the auxiliary motor.

The Boyko motor vehicle lock has to be opened manually. It might be possible to hit on the idea to open this motor vehicle lock also by power, for example, if it is produced as a motor vehicle hood lock or a motor vehicle hinged-lid lock. For this purpose, an additional actuation mechanism for the opening lever would, then, have to be provided, for example, by a solenoid. But, this entails considerable technical expense.

While an arrangement for having the solenoid motor operate the locking catch and locking pin when opening is known (German Offenlegungsschrift 37 08 095, in which a free-wheel connection is provided), it is not feasible to apply this technique to the Boyko vehicle lock, on which this invention is based. This is because of the location of the solenoid motor and locking parts on opposed body parts in this known approach.

SUMMARY OF THE INVENTION

The primary object of the present invention is to configure and further develop the initially explained, Boyko motor vehicle lock, so that it can also be opened by a motor without special technical expense.

This object and others are achieved in a motor vehicle closure lock, for a vehicle hood or trunk or tailgate lid or the like, having the initially-mentioned features by making the pawl detach from the latch with locking catch by a dynamic effect derived from the rotation of the locking pin from the main locking position in the direction of the preliminary locking position, so that the locking catch is thus releasable.

According to the invention, it has been recognized that the locking pin represents a power transmission element, which makes it possible to transmit the driving power of the auxiliary motor, placed on a body part, to the lock mechanism placed on the opposite body part. Thus, use is made of the finding according to the invention that, logically, a mechanical connection of the lock mechanism with the locking catch and pawl is provided with the locking pin in the case of a locked motor vehicle lock. But, this is also only the phase in which, to open the motor vehicle lock, the pawl has to be power-actuated by the auxiliary motor, to be detached from the latching with the locking catch.

With this consideration, there is, then, the possibility to use the rotation of the locking pin for action on the pawl. This can occur by an interposed lever in the lock mechanism, which is actuated by the locking pin, but can be detached from the latter when opening the motor vehicle door.

These and further objects, features and advantages of the present invention will become apparent from the following description when taken in connection with the accompanying drawings which show, for purposes of illustration only, several embodiments in accordance with the present invention.

DETAILED DESCRIPTION OF THE PREFERRED EMBODIMENTS

Figure 1:
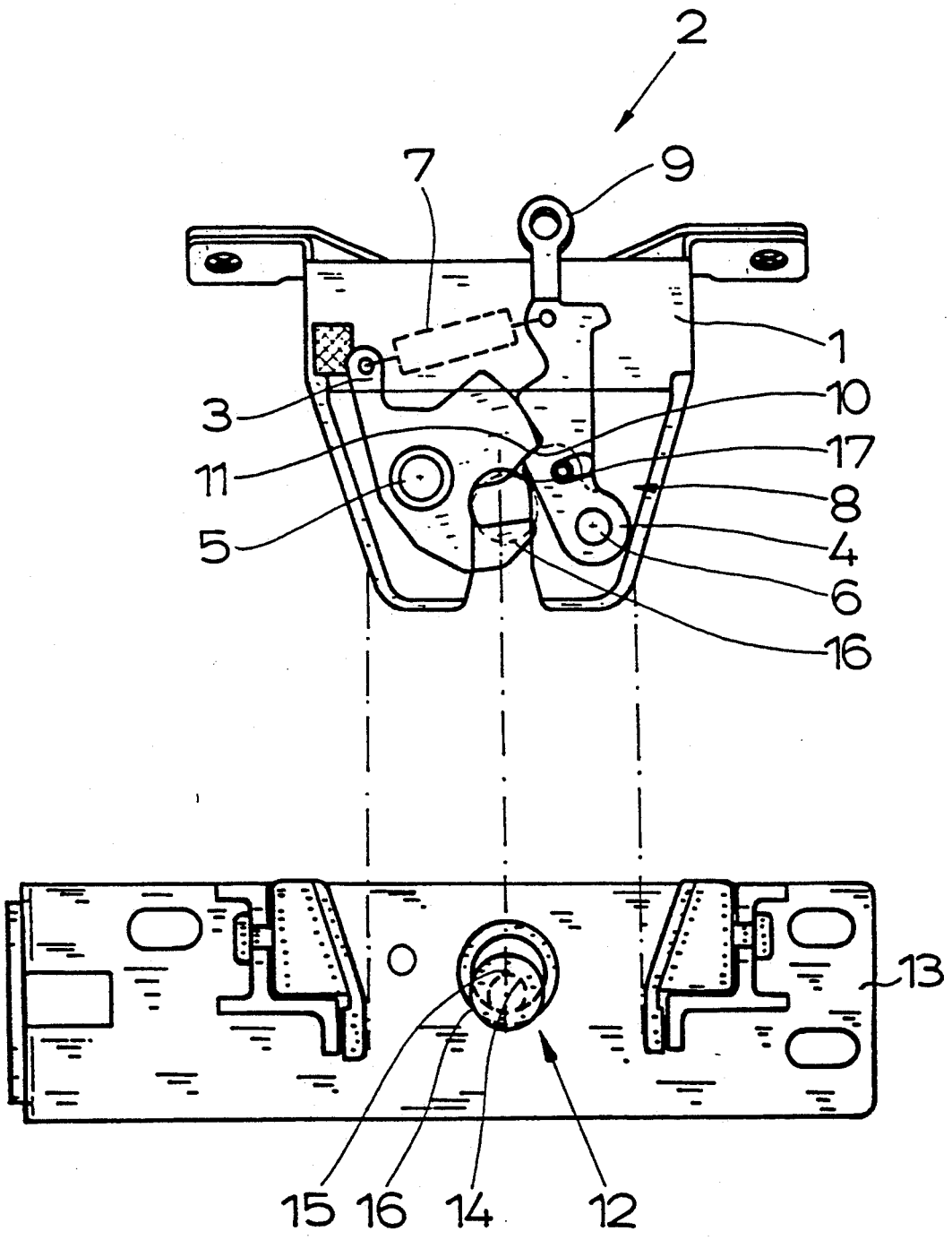
FIG. 1 is an exploded view of a motor vehicle lock in a configuration fur use as a lock for a motor vehicle hinged-closure.

FIG. 1 shows a motor vehicle lock for a hinged closure, such as a tailgate of a station wagon. In general, lock mechanism 2 of the motor vehicle hinged-closure lock is shown on a carrier 1 which, in most cases, will be located on the tailgate. Lock mechanism 2 includes a locking catch 3, that can be shifted from an unlatched position into a latched position, and a pawl 4 which blocks the locking catch 3 from swinging about its pivot axis 5.

Pawl 4 is able to pivot about an axis 6 and a spring 7 prestresses the locking catch 3 and pawl 4 against one another into the position shown. Spring 7 also is used as an ejector spring for locking catch 3. Pawl 4 is connected by a slotted pin connection 8 with an opening lever 9, which can be pulled to open it mechanically. Pawl 4 has a latching notch 10 which grasps a latching shoulder 11 on locking catch 3, and thus, holds the catch 3 in the represented latched position. If opening lever 9 is pulled in a clockwise direction, it slaves pawl 4, and thus, lifts latching notch 10 off of latching shoulder 11, so that the locking catch 3 can pivot in a clockwise direction into an unlatched position, releasing the locking pin 12 (which is shown in broken lines in the lower portion of FIG. 1.

Locking pin 12 is attached to a carrier 13, which is usually placed on the vehicle body frame. Locking pin 12 is mounted to rotate around an axis 15 which is eccentrically positioned relative to its center axis 14. Rotation of locking pin 12 axis 15 between a preliminary locking position and the main locking position represented in FIG. 1 is produced by a servomotor (electric motor, which is not represented here but which may rotate the pin in the same manner as the motor drives the shaft in FIGS. 6 & 7 of the above-noted Boyko patent). By rotation of locking pin 12, the body part which carrying the locking catch 3, here the tailgate, is pulled toward the body part which carrying the locking pin 12, here the body frame, until the main locking position is reached. The main locking position is represented here, and is approximately around the bottom dead center position of locking pin 12.

It is essential that pawl 4 disengage from the locking catch 3 by a dynamic effect derived from the rotation of locking pin 12 from the main locking position in the direction of the preliminary locking position, i.e., upward from the position shown.

As noted above, rotation of locking pin 12 is produced by actuation of the servomotor in a movement of pawl 4 away from locking catch 3, for example by the lever 9 provided in lock mechanism 2 interacting with the locking pin 12 when the motor vehicle lock is closed. However, the embodiment represented in FIG. 1, and in this respect considerably preferred, shows a very much simpler solution, which requires only a quite small change of locking pin 12. Here, locking pin 12 has a control flange 16 lying eccentrically to axis 15, and the pawl 4 has a control surface 17 projecting into the path of movement of control flange 16, and in the main locking position of control flange 16, lies a short distance in front of or just adjoining control surface 17. Pawl 4 is disengaged from locking catch 3 by the rotation of locking pin 12 from the main locking position in the direction of the preliminary locking position, and locking catch 3 released due to control flange 16 being brought against control surface 17 and causing a clockwise swinging of the pawl away from the locking catch 3. That is, even though the exploded representation in FIG. 1, shows control flange 16 spaced from control surface 17 on pawl 4, it is possible to visualize how, with counterclockwise rotation of locking pin 12, from the main locking position of FIG. 1, control flange 16, which will already be adjoining control surface 17 of pawl 4, will lift it off latching shoulder 11, before a significant return movement of locking pin 12 in the direction of the preliminary locking position has taken place.

In the embodiment represented in FIG. 1, it is indicated that it is especially suitable that control flange 16 is provided on the head of locking pin 12. The arrangement of control flange 16 on the head of locking pin 12 corresponds to a configuration of locking pin 12 suitable, anyhow, for safety reasons, so that practically only a rather slight change of existing locking pins 12 is necessary. Of course, control flange 16 can also be placed on another point on the shaft of locking pin 12, if this should be preferred from an assembly aspect.

Figure 2:
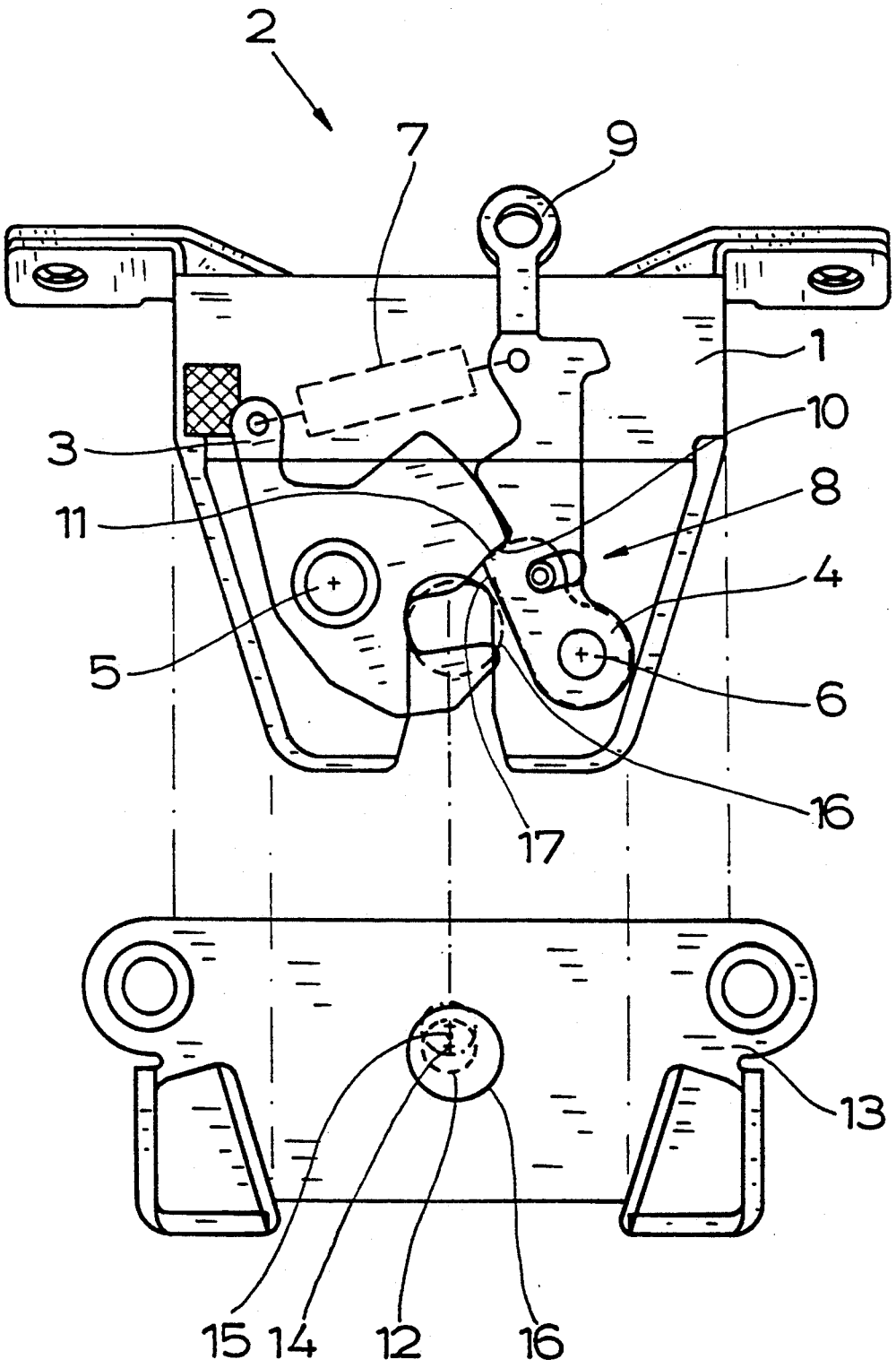
FIG. 2 is a view corresponding to that of FIG. 1, showing a second embodiment of the invention.

The embodiment represented in FIG. 2 is in principle designed exactly as the embodiment represented in FIG. 1. The same reference symbols are used, so that corresponding statements are unnecessary. Also, the top dead center, preliminary locking position of locking pin 12 is indicated by the dot-dash lines about the upper "+" symbol representing the upper position of center line 14. The main locking position is represented in dash lines about the lower "+" symbol and axis 15 lies between the two "+" symbols.

However, the embodiment represented in FIG. 2 differs from the embodiment represented in FIG. 1 in that control flange 16 of locking pin 12 lies not only eccentrically to axis 15 but also eccentrically to center line 14 of locking pin 12. An additional eccentric position of control flange 16 on locking pin 12 causes additional production-engineering expense but, under certain installation conditions, can produce an even better, more precise opening control of pawl 4. In particular, it is achieved, as a result, that control flange 16 already performs a laterally directed opening movement for pawl 4, while locking pin 12 is, itself, still near the bottom dead center position.

According to the invention, by using locking pin 12 for the provided design of a motor vehicle lock, a likewise simple triggering of the pawl for opening the motor vehicle lock is possible, as is the case for the differently designed motor vehicle door locks which have a locking catch actuated by the solenoid motor.

I claim:

1. Motor vehicle lock for a motor vehicle closure member having a locking catch that is movable between an unlatched position and a latched position, a pawl for holding the locking catch in the latched position by latching engagement therewith, and a locking pin rotatably mounted on a carrier for rotation about an axis of rotation which is eccentric to a central axis thereof, said locking pin being rotatable by a motor around said axis of rotation between a preliminary locking position and a main locking position; wherein the pawl is disengageable from latching engagement with the locking catch by a dynamic effect derived from the rotation of the locking pin from the main locking position in a direction toward the preliminary locking position, thereby releasing the locking catch.

2. Motor vehicle lock according to claim 1, wherein the locking pin has a control flange lying eccentrically with respect to the axis of rotation of the locking pin; wherein the pawl has a control surface projecting into a path of movement of the control flange and in the main locking position; wherein the control flange essentially adjoins the control surface; and wherein the pawl is disengaged from latching engagement with the locking catch by engagement of the control flange with the control surface produced by the rotation of the locking pin from the main locking position in the direction of the preliminary locking position.

3. Motor vehicle lock according to claim 2, wherein the control flange also lies eccentrically with respect to said central axis of the locking pin.

4. Motor vehicle lock according to claim 3, wherein the control flange is provided on an end of the locking pin.

5. Motor vehicle lock according to claim 2, wherein the control flange is provided on an end of the locking pin.

6. Motor vehicle lock according to claim 2, wherein said latching engagement is produced by engagement of a latching shoulder of the latching catch in a latching notch in the pawl.

7. Motor vehicle lock according to claim 1, wherein said latching engagement is produced by engagement of a latching shoulder of the locking catch in a latching notch in the pawl.

* * * * *